US010109443B2

(12) United States Patent
Keller

(10) Patent No.: US 10,109,443 B2
(45) Date of Patent: Oct. 23, 2018

(54) HIGH AMP CIRCUIT BREAKER WITH TERMINAL ISOLATION FASTENER CAP

(71) Applicant: Cooper Technologies Company, Houston, TX (US)

(72) Inventor: Matthew Cooper Keller, Portland, OR (US)

(73) Assignee: Cooper Technologies Company, Houston, TX (US)

( * ) Notice: Subject to any disclaimer, the term of this patent is extended or adjusted under 35 U.S.C. 154(b) by 26 days.

(21) Appl. No.: 15/460,926

(22) Filed: Mar. 16, 2017

(65) Prior Publication Data

US 2018/0269019 A1 Sep. 20, 2018

(51) Int. Cl.

*H01H 71/02* (2006.01)
*H01H 71/08* (2006.01)
*H01H 9/02* (2006.01)

(52) U.S. Cl.

CPC ..... *H01H 71/025* (2013.01); *H01H 71/08* (2013.01); *H01H 9/0264* (2013.01); *H01H 71/02* (2013.01)

(58) Field of Classification Search

CPC ..... H01H 71/025; H01H 71/08; H01H 71/02; H01H 9/0264; H01H 71/0207; H01H 9/287

USPC ..... 200/43.01, 333, 43.14, 43.16, 43.19, 200/43.21, 334, 43.11, 43.22, 293; 337/91, 365, 68, 72, 357, 55

See application file for complete search history.

(56) References Cited

U.S. PATENT DOCUMENTS 5,004,994 A 4/1991 Korczynski et al.
5,021,761 A * 6/1991 Stack ..... H01H 73/24 337/365
D357,669 S * 4/1995 Stack ..... D13/160
6,538,549 B1 * 3/2003 Renne ..... H01H 73/28 337/36
6,744,345 B2 * 6/2004 Korczynski ..... H01H 73/24 337/357
7,382,223 B2 * 6/2008 Krishnamurthy ..... H01H 73/24 337/53
7,429,906 B2 * 9/2008 Korczynski ..... H01R 13/6658 335/6

OTHER PUBLICATIONS

MP Series 17 Data Sheet, Mechanical Products Company, 2016.

* cited by examiner

*Primary Examiner* — Ahmed Saeed
(74) *Attorney, Agent, or Firm* — Ziolkowski Patent Solutions Group, SC

(57) ABSTRACT

A high amperage circuit breaker and terminal isolation fastener cap is disclosed. The circuit breaker includes a base having a cavity formed in a top surface thereof, with a mounting hole located within the cavity. Input and output terminal studs are secured to the base and are positioned in a side-by-side arrangement. The hinged fastener cap comprises a fastener receptacle positioned within the cavity of the base and a cover member rotatably attached to the fastener receptacle via a hinge member, such that the cover member may be rotated to a closed position relative to the fastener receptacle. The cover member includes a dividing flange formed thereon that, when the cover member is in the closed position, forms at least part of a dividing structure positioned between the input and output terminal studs to provide electrical isolation therebetween.

20 Claims, 6 Drawing Sheets

HIGH AMP CIRCUIT BREAKER WITH TERMINAL ISOLATION FASTENER CAP

BACKGROUND OF THE INVENTION

The present invention relates generally to circuit breakers and, more particularly, to a high amperage circuit breaker having a terminal isolation fastener cap, along with methods of manufacturing and assembly thereof.

High amperage circuit breakers—or "high amp circuit breakers"—are typically used in primary feed, auxiliary, and/or accessory circuits for trucks, buses, RVs and marine applications. All high amp circuit breakers comply with the SAE J1117 standard for ignition protection and have applications in battery charger systems and DC audio systems, with such circuit breakers providing current protection from 50 to 200 amps, for example. High amp circuit breakers are available in auto reset (Type 1) or manual reset (Type 3) and operate such that, if a fault condition is detected, the unit will immediately discontinue electrical flow to protect the circuit, with the circuit breaker then being automatically or manually reset before resuming operation. High amp circuit breakers typically feature surface mount splash and dust proof sealed outer casings ideal for engine compartment or marine type applications, with as many as six circuit breakers often being stacked in a side-by-side arrangement in the outer casting.

High amp circuit breakers 2, 4 of known construction are shown in FIGS. 1 and 2, with the high amp circuit breakers being for use in trucks, buses, RVs and marine applications and being constructed as a flush-mount or panel-mount circuit breaker. As shown in FIGS. 1 and 2, each of the circuit breakers 2, 4 include a pair of external terminal studs 6, 8 extending from a base 10 to provide an input and output to/from the circuit breaker. A plurality of mounting holes 12 are also formed in the base 10 that are configured to receive fasteners therein that mount the circuit breaker 2, 4 to a panel in the truck, bus, RV or marine craft in which the circuit breaker is employed.

In the embodiment of FIG. 1, it is seen that the input and output terminal studs 6, 8 are located on opposite sides of a central housing 14 of the base 10, so as to provide isolation therebetween. In the embodiment of FIG. 2, it is seen that the input and output terminal studs 6, 8 are located adjacent to one another on a common side of the central housing 14, with it being recognized that this side-by-side arrangement of the input and output terminal studs 6, 8 takes up less surface area on a system level and makes installation of the terminal studs easier, as compared to the terminal stud arrangement in the circuit breaker 2 of FIG. 1.

While the arrangement of the input and output terminal studs 6, 8 in the circuit breaker 4 of FIG. 2 is an improvement over the terminal studs arrangement in the circuit breaker 2 of FIG. 1 for the reasons indicated above, it is recognized that there are still shortcomings associated with the circuit breaker construction illustrated in FIG. 2. As one example, due to the proximity of the input and output terminal studs 6, 8 in the circuit breaker 4 of FIG. 2, a dividing wall 16 is required therebetween in order to provide electrical isolation between the studs; however, existing dividing wall designs are insufficient to prevent shorting between the terminal studs, as the dividing wall 16 does not extend high enough above the terminal studs. As another example, the circuit breaker 4 of FIG. 2 is constructed such that ring terminals (not shown) positioned on the and output terminal studs 6, 8 must be installed at an angle relative to one another rather than parallel to one another, as would be desirable. That is, the circuit breaker 4 of FIG. 2 includes a mounting hole 12 positioned between and directly adjacent to the terminal studs 6, 8, with the mounting hole 12 including a circular flange 18 protruding up from the base 10 and encircling the mounting hole to isolate a fastener placed therein. The protruding of the circular flange 18 up from the base 10 prevents the ring terminals from being oriented parallel to one another, as the circular flange 18 interferes with such an arrangement/alignment and forces the ring terminals to be installed at an angle relative to one another.

It would therefore be desirable to provide a high amp circuit breaker design that offers sufficient electrical isolation between input and output terminal studs. It would further be desirable for such a high amp circuit breaker to allow for attachment and orientation of ring terminals on the terminal studs in an optimal orientation.

BRIEF DESCRIPTION

In accordance with one aspect of the invention, a circuit breaker includes a base comprising a top surface and having formed therein a plurality of mounting holes configured to receive fasteners for mounting the circuit breaker to an external surface and a cavity formed in the top surface of the base, with one of the plurality of mounting holes located within the cavity. The circuit breaker also includes input and output terminal studs secured to the base and extending outwardly from the top surface, the input and output terminal studs positioned in a side-by-side arrangement to provide input and output power connections on the circuit breaker. The circuit breaker further includes a hinged fastener cap comprising a fastener receptacle positioned within the cavity of the base and a cover member rotatably attached to the fastener receptacle via a hinge member, such that the cover member may be rotated to a closed position relative to the fastener receptacle. The cover member includes a dividing flange formed thereon that, when the cover member is in the closed position, forms at least part of a dividing structure positioned between the input and output terminal studs to provide electrical isolation therebetween.

According to yet another embodiment of the invention, a method of providing electrical isolation in a circuit breaker includes positioning a hinged fastener cap within a cavity formed in a base of the circuit breaker, the hinged fastener cap comprising a fastener receptacle having an opening formed therein and a cover member rotatably attached to the fastener receptacle via a hinge member to enable rotation of the cover member to a closed position relative to the fastener receptacle, the cover member including a dividing flange formed thereon. The method also includes placing a fastener through the opening of the fastener receptacle and into a mounting hole of the base located in the cavity and actuating the hinged fastener cap to the closed position such that the fastener is covered by the fastener cap to provide electrical isolation thereto, with the dividing flange of the fastener cap being generally positioned in an area between input and output terminal studs of the circuit breaker when the hinged fastener cap is in the closed position.

In accordance with yet another aspect of the invention, a terminal isolation fastener cap for use in a circuit breaker includes a fastener receptacle configured to receive a fastener and be positionable within a cavity formed in a base of the circuit breaker, a hinge, and a cover member connected to the fastener receptacle via the hinge, such that the cover member may be rotated between an open position and a closed position relative to the fastener receptacle, with the cover member including a dividing flange formed thereon.

Various other features and advantages of the present invention will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Embodiments of the invention are directed to a high amp circuit breaker that provides sufficient electrical isolation between input and output terminal studs, while also allowing for attachment and orientation of ring terminals on the terminal studs in an optimal orientation. The circuit breaker includes a base having a cavity formed therein for receiving a fastener that mounts the circuit breaker to an external panel or surface. A hinged fastener cap is positioned within the cavity and closed over the fastener upon positioning thereof within the cavity, with the hinged fastener cap electrically isolating the fastener from terminal studs of the circuit breaker and also electrically isolating the terminal studs from one another.

While an embodiment of the invention is shown and described below for a surface mounted high-amp manual reset circuit breaker having a specific construction, it is recognized that embodiments of the invention also encompass other circuit breaker constructions and configurations. That is, embodiments of the invention may also be directed to circuit breakers of other types, constructions and ratings, including, for example, auto reset and panel mount circuit breakers. Accordingly, the specific description of a surface mounted high-amp manual reset circuit breaker as set forth below is not meant to limit the scope of the invention, and it is recognized that equivalents, alternatives, and modifications, aside from those expressly described herein, are possible and within the scope of the appending claims.

As used herein, the term "high-amp circuit breaker" is meant to refer to circuit breakers having an amperage rating from 50 to 200 amps and that comply with the SAE J1117 standard for ignition protection.

Figure 1:
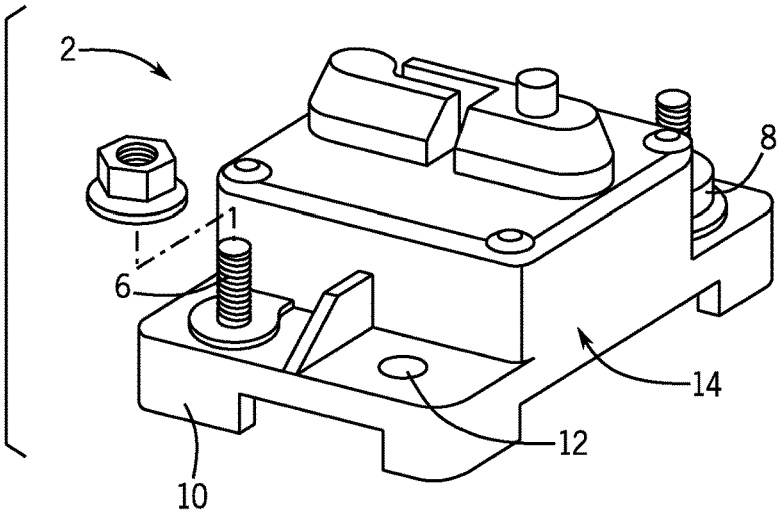
FIG. 1 (PRIOR ART)
FIGS. 1 and 2 are perspective views of surface mounting type circuit breakers having constructions as known in the prior art.
Figure 2:
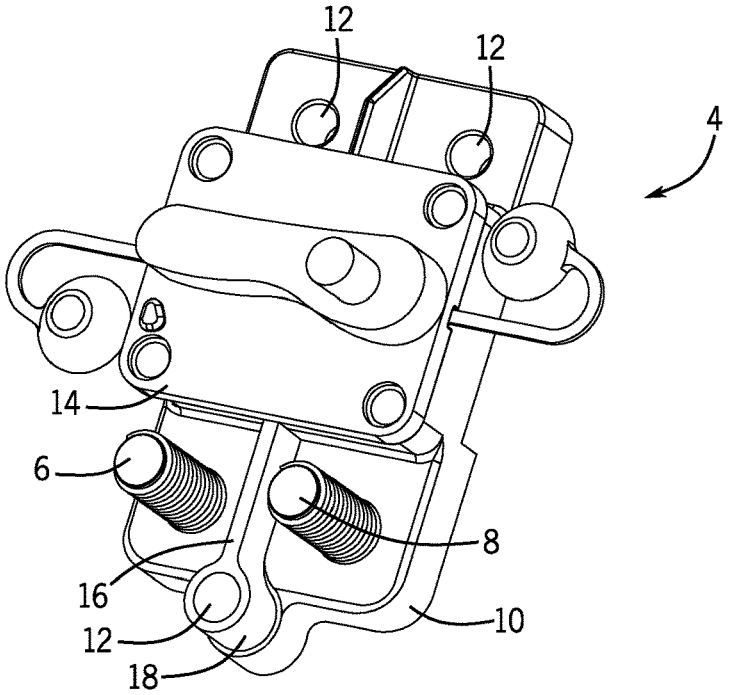
FIG. 2 (PRIOR ART)
Figure 3:
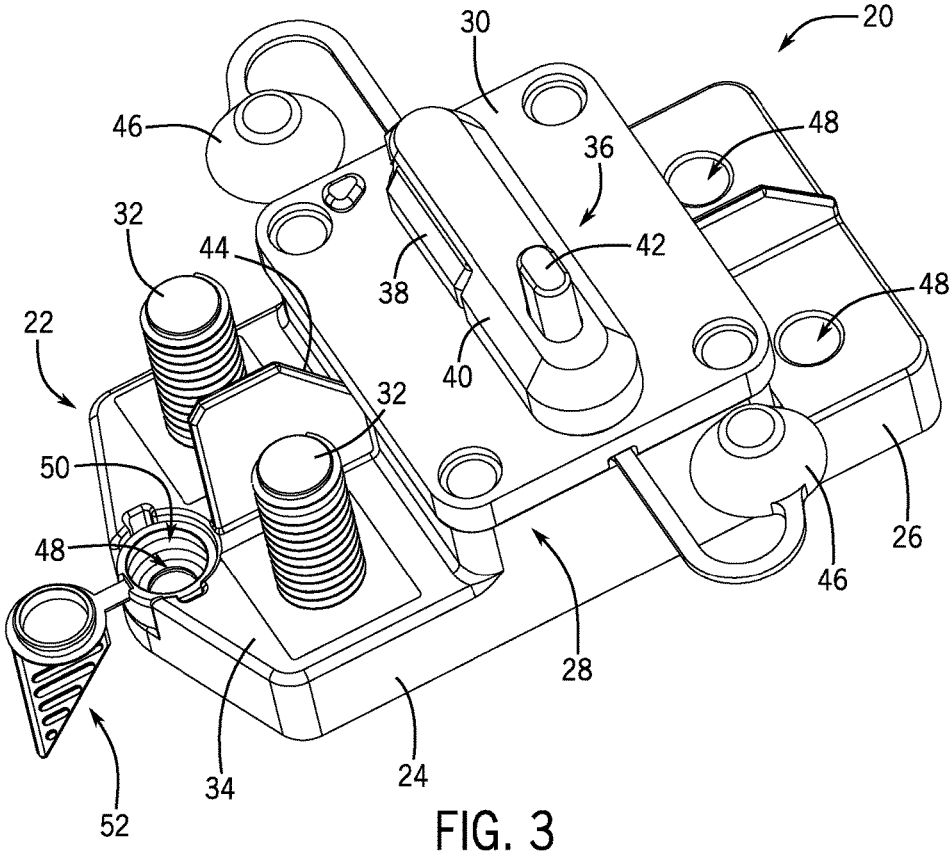
FIG. 3 is a perspective view of a surface mount high-amp manual reset circuit breaker with a fastener cap in an open position, in accordance with an embodiment of the invention.

Referring to FIG. 3, a surface mount high-amp manual reset circuit breaker 20 is shown according to an exemplary embodiment of the invention. The circuit breaker 20 is constructed of a base 22 that generally includes a pair of end portions 24, 26 that are formed on either side of a central housing 28, with it being understood that the central housing 28 (and a cover 30 provided thereon) defines a chamber that includes therein a number of components (not shown) that are operable to enable the circuit breaker 20 to selectively conduct and interrupt a flow of power therethrough, as is known in the art. The base 22 and central housing 28 thereof may be formed from any typical type of electrically insulating material, such as various plastics or other suitable materials. The circuit breaker 20 also includes a pair of terminal studs 32—i.e., input and output terminal studs—located on one of the end portions 24 of base 22 and that provide input and output power to and from the circuit breaker 20, with the terminal studs 32 being placed in series with the circuit to be protected. The terminal studs 32 extending upwardly and outwardly from a top surface 34 of the base 22 and are located adjacent to one another on end portion 24, with it being recognized that this side-by-side arrangement of the input and output terminal studs 32 takes up less surface area on a system level and makes installation and reaching of the terminal studs 32 easier.

On top of the central housing cover 24 is a blank preferably hollow raised housing 36 and a pivoting reset lever 38. The reset lever pivots about its end as is described in more detail below. Blank housing 36 is utilized to give an aesthetic appearance to the circuit breaker 20 and is shaped to complement the features of the reset lever 38. Also, a stationary portion 40 prevents the reset lever 38 from being accidentally turned in the direction of the stationary portion 40 and that might damage the circuit breaker 20 and require replacement, such as might occur during shipping or use. The manual reset lever 38 is in a side by side fit with the blank housing 36 and is rotated or pivoted when there is an overload current of a predetermined magnitude. When the reset lever 38 is pivoted to its trip position, the circuit of the circuit breaker 20 is opened to prevent electricity from passing therethrough. After the overload condition ceases and a predetermined time has passed, the reset lever handle 38 can be returned manually to its initial position and return the circuit breaker 20 to its closed circuit position. A push-to-trip button 42 is also included on circuit breaker 20 that may be used to manually place the circuit breaker 20 in an open circuit condition, with the push-to-trip button 42 being slideably mounted in the raised housing 36 and interacting with components inside of central housing 28.

As shown in FIG. 3, the base 22 of circuit breaker 20 also includes a dividing wall 44 formed thereon on end portion 24 on which terminal studs 32 are positioned. The dividing wall 44 may be formed integrally with base 22 or attached thereto in a secure fashion, with the dividing wall 44 being formed of a same material as the base 22 or another suitable electrically insulating material. In either case, the dividing wall 44 extends upwardly and outwardly from the top surface 34 of base 22 at a location between terminal studs 32, with the dividing wall 44 having a height equal to or greater than a height of the terminal studs 32 so as to provide electrical isolation between the studs. In one embodiment, a pair of stud covers 46 are also provided on circuit breaker 20, with the stud covers 46 being flexibly mounted to central housing 28 so as to be movable to a position where they may be placed onto the top of terminal studs 32 in order to provide additional electrical isolation for the studs.

As further shown in FIG. 3, a plurality of mounting holes 48 are formed in the base 22 that receive fasteners (not shown) therein that mount the circuit breaker 20 to a surface or panel in the truck, bus, RV or marine craft in which the circuit breaker 20 is employed. In the illustrated embodiment, a pair of mounting holes 48 are formed in the end portion 26 that is opposite from terminal studs 32 and a single mounting hole 48 is formed in the end portion 24 on which terminal studs 32 are positioned; however, it is recognized the number and positioning of mounting holes 48 in the end portion that is opposite from terminal studs 32 may vary. With regard to mounting hole 48 in end portion 24, it is seen that the mounting hole 48 is formed in end portion 24 at a location between terminal studs 32 and adjacent to dividing wall 44.

Figure 4:
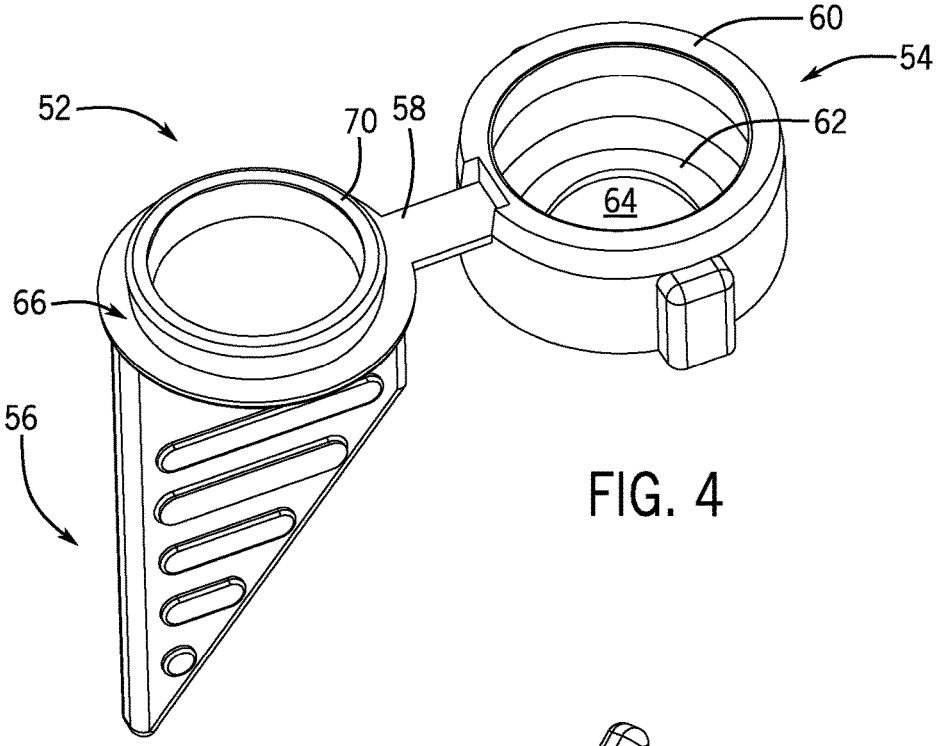
FIGS. 4 and 5 are perspective views of the fastener cap of FIG. 3 in open and closed positions, in accordance with an embodiment of the invention.
Figure 5:
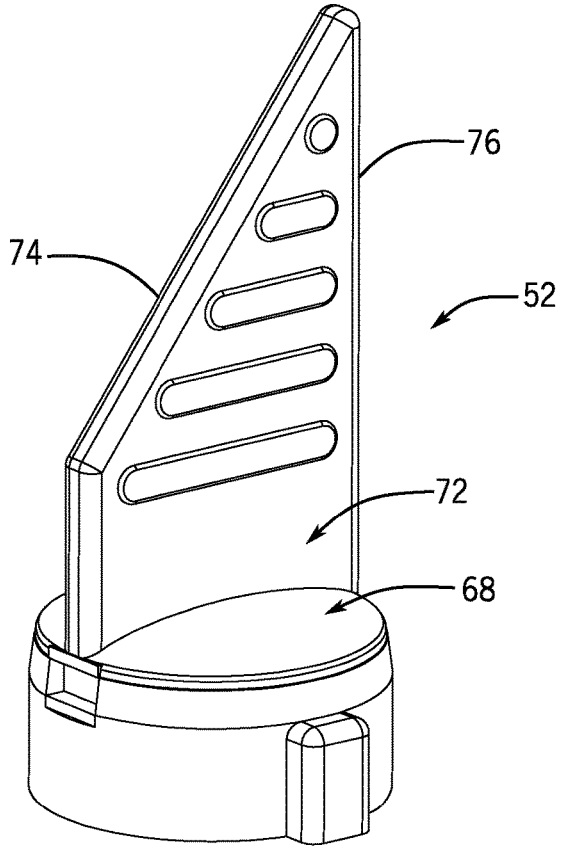

As shown in FIG. 3, the mounting hole 44 in end portion 24 is located within a cavity 50 that is formed in base 22 and is centered within the cavity 50, with the cavity 50 being sized so as to receive therein a fastener cap 52 that may be placed over the fastener once it has been secured within mounting hole 48. Referring now to FIGS. 4 and 5, and with continued reference to FIG. 3, it is shown that the fastener cap 52 is formed as a hinged member with a fastener receptacle 54 and cover member 56 joined together via a hinge 58 and is formed of a suitable electrically insulating material such as unfilled nylon or polypropylene, for example, that provides electrical isolation for the fastener (i.e., between the fastener and terminal studs 32). The fastener receptacle 54 is generally defined by a circular outer wall 60 and ring-shaped bottom wall 62 that defines an opening 64 in which a fastener is received, with the opening 64 being aligned with the mounting hole 48 in base 22 to allow for placement of a fastener therein. The outer wall 60 is formed so as to fit within cavity 50 of base 22 and has a height/thickness that allows for it to fit within cavity 50 in such a manner that it does not extend above the top surface 34 of base 22.

The cover member 56 of fastener cap 52 is formed to generally include a bottom surface 66 and a top surface 68. The bottom surface 66 of cover member 56 includes a mating feature 70 formed thereon that allows the cover member 56 to be joined to fastener receptacle 54 when the cover member 56 is rotated (via hinge) to a closed position relative to the fastener receptacle 54. In the illustrated embodiment, the mating feature 70 is formed simply as a ring-shaped protrusion that fits within the an outer circumference of the circular outer wall 60; however, it is recognized that the mating feature 70 could instead be in the form of a clip or other feature that would provide for securing of the cover member 56 to the fastener receptacle 54. When the cover member 56 is rotated to the closed position, the circular outer wall 60 and the cover member 56 thus enclose the respective fastener therein, so as to electrically isolate the fastener.

The top surface 68 of cover member 56 is formed so as to present a generally flat surface except for a dividing flange 72 that extends outwardly therefrom. When the cover member 56 is rotated to the closed position and mates with the fastener receptacle 54, the overall height of the fastener cap 52 is such that the top surface of the cover member 56 (excluding the dividing flange 72) will not extend up past the top surface of circuit breaker base 22, with the top surface of the cover member 56 being either flush with the top surface of base 22 or at a height below the top surface of the base 22 within cavity 50.

Figure 6:
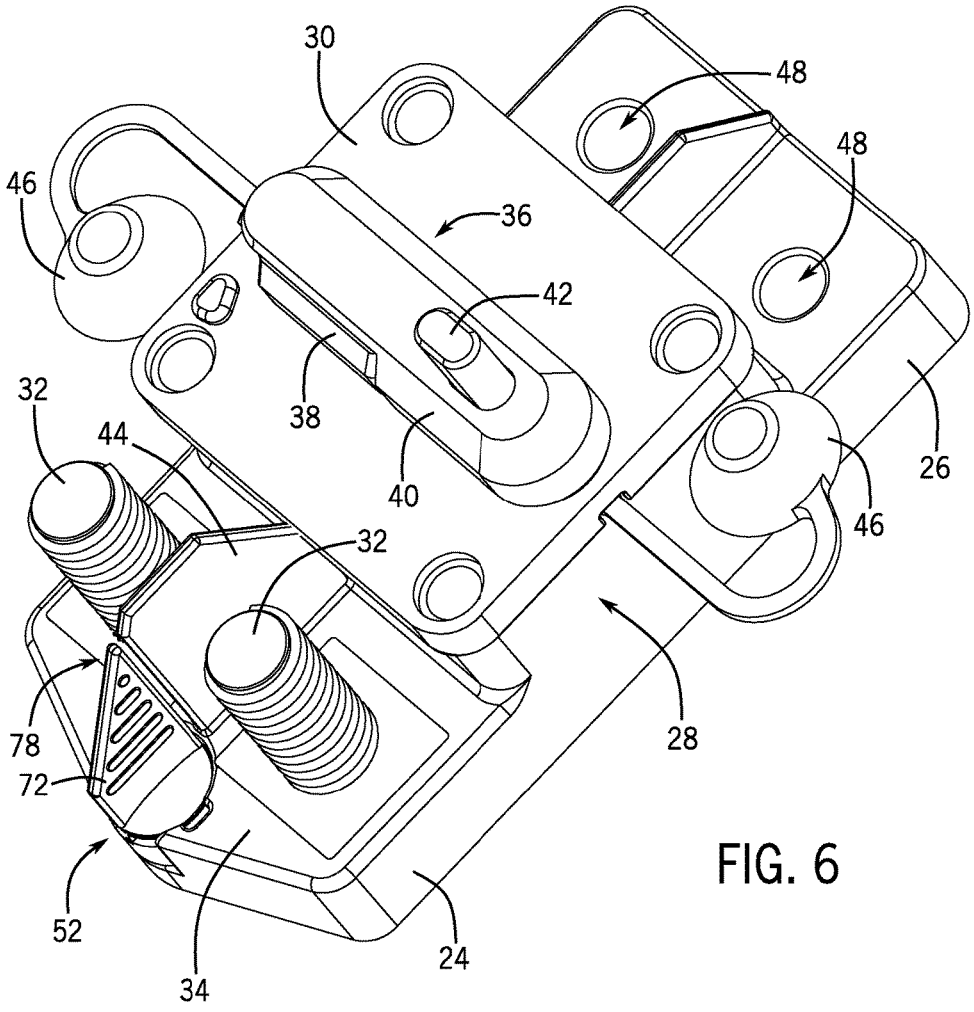
FIG. 6 is a perspective view of the surface mount high-amp manual reset circuit breaker of FIG. 3 with fastener cap in a closed position, in accordance with an embodiment of the invention.

The dividing flange 72 of cover member 56 may be centered on top surface so as to bisect the cover member 56, with a width of the dividing flange 72 extending across a diameter of the cover member 56. According to one embodiment, the dividing flange 72 has a generally fin-shaped construction with an angled edge 74 and a vertical edge 76, with the height of the dividing flange 72 being equal or essentially equal to the height of the dividing wall 44 on base 22. The vertical edge 76 is positioned/oriented such that it aligns with the dividing wall 44 when the fastener cap 52 is positioned within cavity 50 of base 22 and the cover member 56 is rotated to the closed position to mate with the fastener receptacle 54. The dividing flange 72 thus operates in conjunction with the dividing wall 44 to provide an overall dividing structure 78 that provides desirable electrical isolation between the input and output terminal studs 32 of the circuit breaker 20, as shown in FIG. 6.

Figure 7:
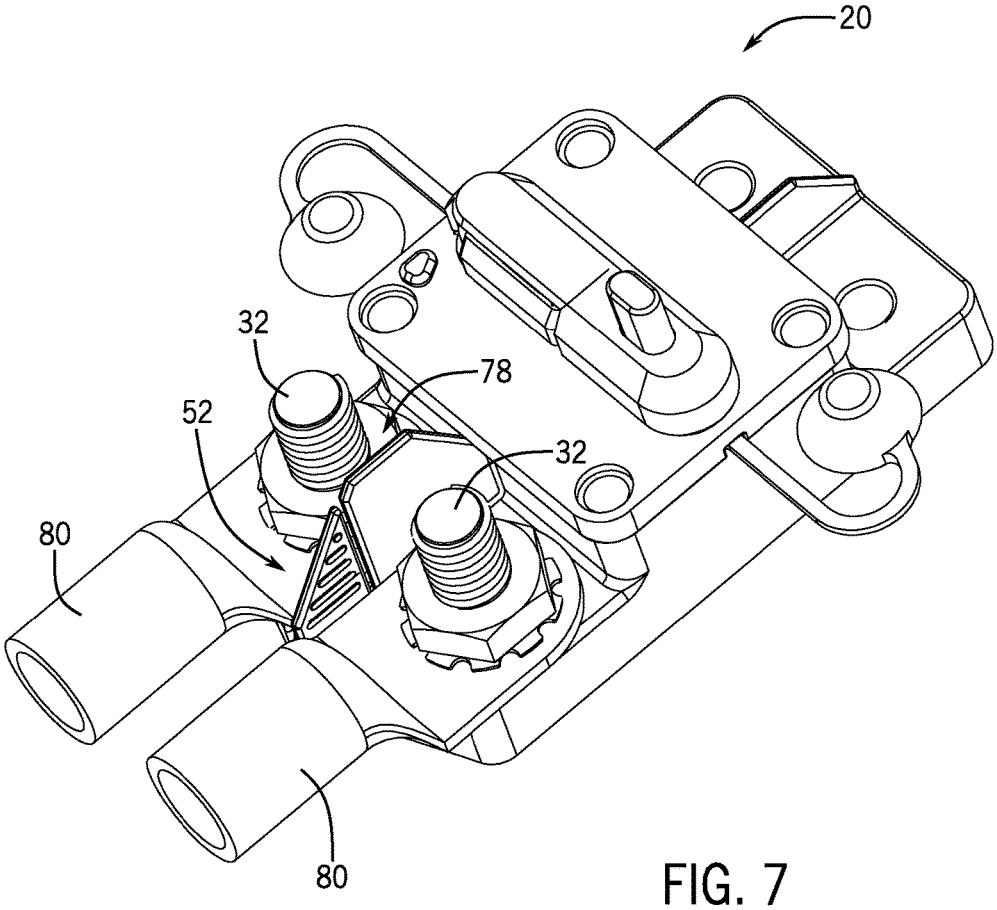
FIG. 7 is a perspective view of the surface mount high-amp manual reset circuit breaker of FIG. 3 with ring terminals attached to the terminal studs of the circuit breaker, in accordance with an embodiment of the invention.

Referring now to FIG. 7, it is seen that the arrangement of terminal studs 32, the construction of mounting hole 48 within cavity 50 of base 22, and the positioning/inclusion of the fastener and fastener cap 52 within cavity 50 and relative to terminal studs 32 allows for a simple and desirable attachment and alignment of ring terminals 80 on the terminal studs 32—so as to provide input and output power to and from the circuit breaker 20. That is, the positioning of the fastener and fastener cap 52 within the cavity 50 of base 22, along with the specific construction of the fastener cap 52 allow for placement of the ring terminals 80 in a desirable parallel orientation relative to one another, as the fastener and fastener cap 52 do not interfere with such placement/orientation of the ring terminals 80. Attachment of the ring terminals 80 to the terminal studs 32 in such a parallel orientation allows for the circuit breaker 20 to take up a minimum amount of packaging space, which is desirable when mounting a number of circuit breakers 20 in a side-by-side arrangement on a common surface or panel. The dividing structure 78 provides desirable electrical isolation between the as ring terminals 80 and the input and output terminal studs 32 of the circuit breaker 20.

While dividing flange 72 of cover member 56 is described above and shown in FIGS. 3-7 as having a width essentially equal to a diameter of the cover member 56, it is recognized that the dividing flange 72 may be sized differently according to other embodiments of the invention. That is, in an alternative embodiment, a width of the dividing flange 72 may be increased such that it extends out past a diameter of the cover member 56. In such an embodiment, the dividing flange 72 may be sized such that it forms an entirety of a dividing structure 78 between the terminal studs 32 and ring terminals 80 of circuit breaker 20, with the dividing wall 44 of base 22 being removed and unnecessary in such an embodiment (i.e. replaced by the dividing flange 72).

Figure 8:
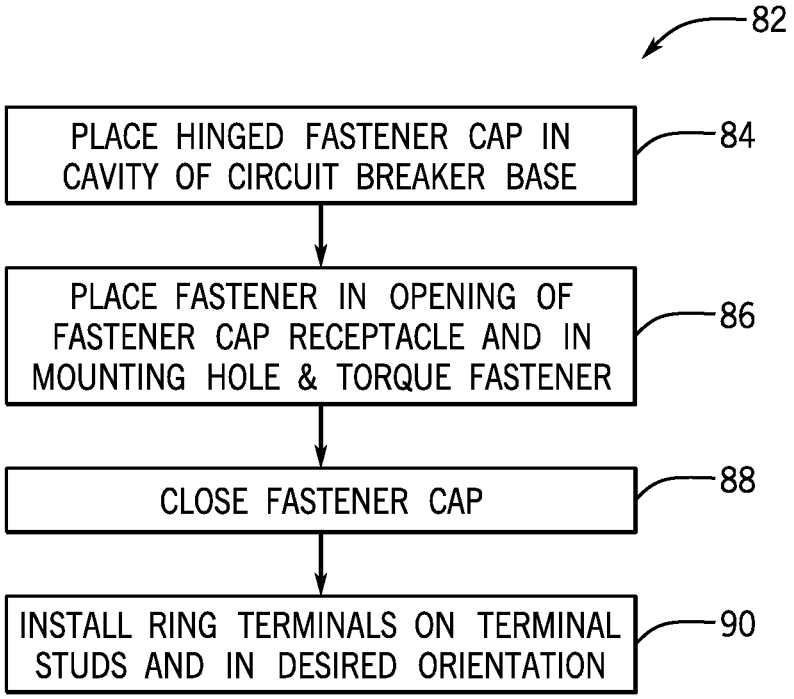
FIG. 8 is a flowchart illustrating a method for mounting the circuit breaker of FIG. 3 and installing the fastener cap thereon, according to an embodiment of the invention.

Referring now to FIG. 8, a flowchart setting forth a method 82 for mounting the circuit breaker 20 and installing the fastener cap 52 therein is illustrated, according to an embodiment of the invention. In a first step of the method 82, the hinged fastener cap 52 is placed in the cavity 50 formed in base 22 of circuit breaker 20 at STEP 84, with the fastener cap 52 being in an "open" state where the cover member 56 is not rotated so as to be joined with fastener receptacle 54. Upon placement of the fastener cap 52 within cavity 50, a fastener is then placed through the opening 64 of fastener receptacle 54 and into mounting hole 48 (of end portion 24) of the circuit breaker base 22 and subsequently torqued at STEP 86, thereby clamping both the hinged fastener cap 52 to the base 22 and the base 22 to a surface or panel of its application (e.g., truck, bus, RV or marine application).

In proceeding with the method 82, the hinged fastener cap 52 is then closed at STEP 88 such that the fastener is covered by the fastener cap 52. The fastener cap 52 functions to isolate the fastener from the terminal studs 32 and also isolate the terminal studs 32 from one another, as the closing of the fastener cap 52 aligns the dividing flange 72 with the dividing wall 44 on base 22, so as to form a complete dividing structure 78 that ensures isolation between the terminal studs 32. Upon closing of the fastener cap 52, the method 82 continues at STEP 90, where the ring terminals 80 are installed on the terminal studs 32. According to embodiments of the invention, the ring terminals 80 can be installed parallel to one another on the terminal studs 32 based on the structure of base 22 and fastener cap 52 and the positioning of the fastener cap 52 and the fastener relative to the base 22 and the terminal studs 32.

Beneficially, embodiments of the invention thus provide a high amp circuit breaker design and accompanying fastener cap that offer sufficient electrical isolation between input and output terminal studs of the circuit breaker (and a fastener) to prevent inadvertent shorting therebetween, while allowing for attachment and orientation of ring terminals on the terminal studs in an optimal orientation. Attachment of the ring terminals to the terminal studs in such a parallel orientation allows for the circuit breaker to take up a minimum amount of packaging space, which is desirable when mounting a number of circuit breakers in a side-by-side arrangement on a common surface or panel.

Therefore, according to one embodiment of the invention, a circuit breaker includes a base comprising a top surface and having formed therein a plurality of mounting holes configured to receive fasteners for mounting the circuit breaker to an external surface and a cavity formed in the top surface of the base, with one of the plurality of mounting holes located within the cavity. The circuit breaker also includes input and output terminal studs secured to the base and extending outwardly from the top surface, the input and output terminal studs positioned in a side-by-side arrangement to provide input and output power connections on the circuit breaker. The circuit breaker further includes a hinged fastener cap comprising a fastener receptacle positioned within the cavity of the base and a cover member rotatably attached to the fastener receptacle via a hinge member, such that the cover member may be rotated to a closed position relative to the fastener receptacle. The cover member includes a dividing flange formed thereon that, when the cover member is in the closed position, forms at least part of a dividing structure positioned between the input and output terminal studs to provide electrical isolation therebetween.

According to another embodiment of the invention, a method of providing electrical isolation in a circuit breaker includes positioning a hinged fastener cap within a cavity formed in a base of the circuit breaker, the hinged fastener cap comprising a fastener receptacle having an opening formed therein and a cover member rotatably attached to the fastener receptacle via a hinge member to enable rotation of the cover member to a closed position relative to the fastener receptacle, the cover member including a dividing flange formed thereon. The method also includes placing a fastener through the opening of the fastener receptacle and into a mounting hole of the base located in the cavity and actuating the hinged fastener cap to the closed position such that the fastener is covered by the fastener cap to provide electrical isolation thereto, with the dividing flange of the fastener cap being generally positioned in an area between input and output terminal studs of the circuit breaker when the hinged fastener cap is in the closed position.

According to yet another embodiment of the invention, a terminal isolation fastener cap for use in a circuit breaker includes a fastener receptacle configured to receive a fastener and be positionable within a cavity formed in a base of the circuit breaker, a hinge, and a cover member connected to the fastener receptacle via the hinge, such that the cover member may be rotated between an open position and a closed position relative to the fastener receptacle, with the cover member including a dividing flange formed thereon.

The present invention has been described in terms of the preferred embodiment, and it is recognized that equivalents, alternatives, and modifications, aside from those expressly stated, are possible and within the scope of the appending claims.

What is claimed is:

1. A circuit breaker comprising:

a base comprising a top surface and having formed therein:

a plurality of mounting holes configured to receive fasteners for mounting the circuit breaker to an external surface; and a cavity formed in the top surface of the base, with one of the plurality of mounting holes located within the cavity;

input and output terminal studs secured to the base and extending outwardly from the top surface, the input and output terminal studs positioned in a side-by-side arrangement to provide input and output power connections on the circuit breaker;

a hinged fastener cap comprising:

a fastener receptacle positioned within the cavity of the base; and a cover member rotatably attached to the fastener receptacle via a hinge member, such that the cover member may be rotated to a closed position relative to the fastener receptacle;

wherein the cover member includes a dividing flange formed thereon that, when the cover member is in the closed position, forms at least part of a dividing structure positioned between the input and output terminal studs to provide electrical isolation therebetween.

2. The circuit breaker of claim 1 wherein the fastener receptacle comprises:

a circular outer wall sized to fit within the cavity of the base; and a ring-shaped bottom wall attached to a bottom of the circular wall, the ring-shaped bottom wall defining an opening aligned with the mounting hole located within the cavity so as to provide for positioning of a respective fastener therethrough.

3. The circuit breaker of claim 2 wherein the circular outer wall and the cover member enclose the respective fastener therein when the cover member is in the closed position, so as to electrically isolate the fastener.

4. The circuit breaker of claim 2 wherein the cover member comprises a bottom surface having a mating feature formed thereon, the mating feature interacting with the circular outer wall to join the cover member to the fastener receptacle when the cover member is rotated to the closed position.

5. The circuit breaker of claim 1 wherein the base further comprises a dividing wall affixed thereto or formed integrally therewith at a location between the input and output terminal studs to provide electrical isolation therebetween.

6. The circuit breaker of claim 5 wherein the dividing flange of the cover member aligns with the dividing wall of the base when the cover member is in the closed position, so as to form the dividing structure.

7. The circuit breaker of claim 1 wherein the hinged fastener cap is constructed such that a top surface of the cover member does not extend up past the top surface of the base when the cover member is in the closed position relative to the fastener receptacle.

8. The circuit breaker of claim 1 further comprising ring terminals positioned on the input and output terminal studs to provide input and output connections to the circuit breaker, wherein the ring terminals are aligned parallel to one another, without interference from the hinged fastener cap.

9. The circuit breaker of claim 1 wherein the hinged fastener cap is formed of unfilled nylon or polypropylene.

10. The circuit breaker of claim 1 wherein the base comprises:

a center housing; and an end portion on each side of the center housing, with each of the end portions having one or more of the plurality mounting holes formed therein.

11. The circuit breaker of claim 1 wherein the circuit breaker comprises a surface mounted high-amp manual reset circuit breaker.

12. A method of providing electrical isolation in a circuit breaker, the method comprising:

positioning a hinged fastener cap within a cavity formed in a base of the circuit breaker, the hinged fastener cap comprising:

a fastener receptacle having an opening formed therein; and a cover member rotatably attached to the fastener receptacle via a hinge member to enable rotation of the cover member to a closed position relative to the fastener receptacle, the cover member including a dividing flange formed thereon;

placing a fastener through the opening of the fastener receptacle and into a mounting hole of the base located in the cavity; and actuating the hinged fastener cap to the closed position such that the fastener is covered by the fastener cap to provide electrical isolation thereto, with the dividing flange of the fastener cap being generally positioned in an area between input and output terminal studs of the circuit breaker when the hinged fastener cap is in the closed position.

13. The method of claim 12 wherein actuating the hinged fastener cap to the closed position aligns the dividing flange with a dividing wall on the base of the circuit breaker so as to form a dividing structure, with the dividing structure providing electrical isolation between the input and output terminal studs.

14. The method of claim 12 further comprising installing ring terminals on the terminal studs, the ring terminals being oriented so as to be parallel to one another on the terminal studs.

15. The method of claim 14 wherein the dividing flange of the fastener cap provides electrical isolation between the ring terminals.

16. A terminal isolation fastener cap for use in a circuit breaker, the terminal isolation fastener cap comprising:

a fastener receptacle configured to receive a fastener and be positionable within a cavity formed in a base of the circuit breaker;

a hinge; and a cover member connected to the fastener receptacle via the hinge, such that the cover member may be rotated between an open position and a closed position relative to the fastener receptacle, with the cover member including a dividing flange formed thereon.

17. The terminal isolation fastener cap of claim 16 wherein, when the fastener receptacle is positioned within the cavity formed in the base of the circuit breaker and the cover member is in the closed position, the dividing flange extends upwardly from the base of the circuit breaker to form at least part of a dividing structure between input and output terminal studs of the circuit breaker.

18. The terminal isolation fastener cap of claim 15 wherein the fastener receptacle comprises:

a circular outer wall sized to fit within the cavity of the base; and a ring-shaped bottom wall attached to a bottom of the circular wall, the ring-shaped bottom wall defining an opening aligned with the mounting hole located within the cavity so as to provide for positioning of the fastener therethrough.

19. The terminal isolation fastener cap of claim 18 wherein the circular outer wall and the cover member enclose the respective fastener therein when the cover member is in the closed position, so as to electrically isolate the fastener.

20. The terminal isolation fastener cap of claim 18 wherein the cover member comprises a bottom surface having a mating feature formed thereon, the mating feature interacting with the circular outer wall to join the cover member to the fastener receptacle when the cover member is rotated to the closed position.

* * * * *